United States Patent [19]

Caputo et al.

[11] Patent Number: 4,588,076

[45] Date of Patent: May 13, 1986

[54] SMOKERS CONVENIENCE CADDY

[76] Inventors: Mario A. Caputo, 4905 Ave. "M"; Jeffrey C. Caputo, 4903 Ave. "M", both of Brooklyn, N.Y. 11234

[21] Appl. No.: 549,568

[22] Filed: Nov. 7, 1983

[51] Int. Cl.[4] ..... B65D 85/10; A24F 15/08; A24F 19/10

[52] U.S. Cl. ..... 206/86; 206/246; 131/231; 131/239

[58] Field of Search ..... 131/329, 231, 238, 239, 131/234, 240 R, 250; 206/86–89, 236, 239, 38, 246, 496, 119, 120, 806

[56] References Cited

U.S. PATENT DOCUMENTS

| | | | |
|---|---|---|---|
| 1,717,320 | 6/1929 | Victor | 206/236 |
| 1,909,543 | 5/1933 | Jordon | 131/239 |
| 2,323,342 | 7/1943 | McManus et al. | 206/119 |
| 2,349,488 | 5/1944 | Dement | 206/119 |
| 2,775,343 | 12/1956 | Carson | 206/119 |
| 4,230,224 | 10/1980 | Weeks | 206/87 |
| 4,252,237 | 2/1981 | Baclit | 206/86 |
| 4,353,379 | 10/1982 | Castellanos | 131/231 |
| 4,486,169 | 12/1984 | Lewis | 206/85 |

*Primary Examiner*—Vincent Millin
*Assistant Examiner*—H. Macey

[57] ABSTRACT

A smokers' convenience caddy includes a compartmentalized receptacle with detachable components. A base unit adapted for accommodating a conventional package of cigarettes is securable to a selected substantially vertical support surface. An ash container is suspendable from the base unit and alternatively can be utilized at a remote location therefrom. A lighter pod for accepting a cigarette lighter is attachable to a side wall of the base unit and can also be independently deployed.

1 Claim, 6 Drawing Figures

FIG. 1
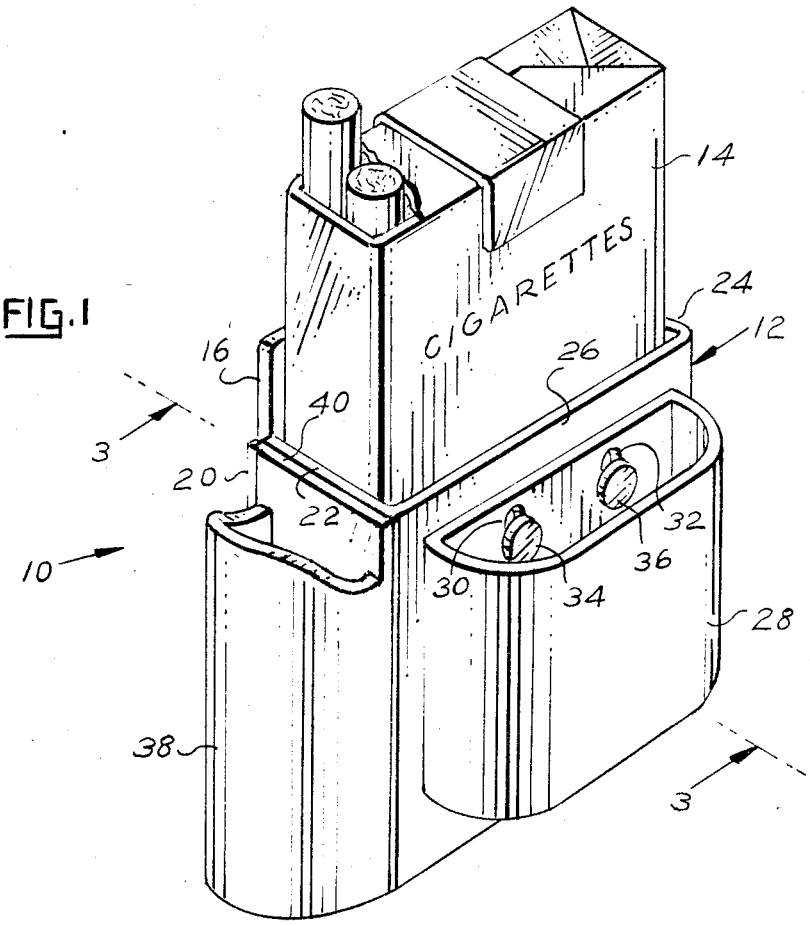
FIG. 3
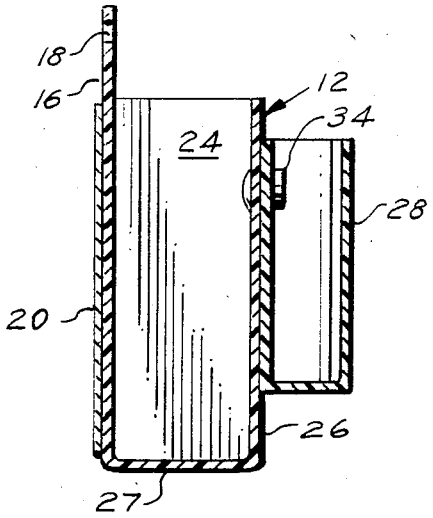
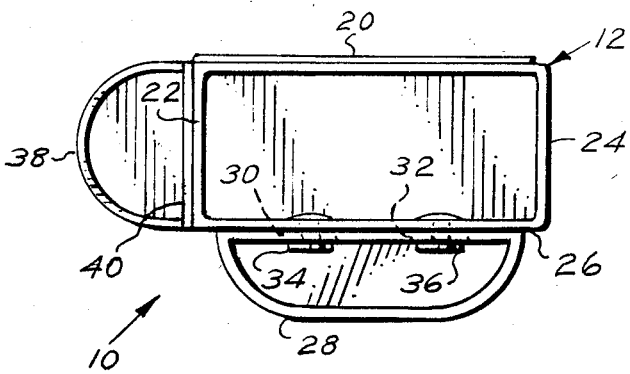
FIG. 2

SMOKERS CONVENIENCE CADDY

TECHNICAL FIELD

This invention relates generally to receptacles and especially to a smokers' convenience caddy having selectively detachable component units.

In particular, the device of this invention concerns a compartmentalized receptacle for supporting smokers' articles such as a package of cigarettes, a cigarette lighter, and an ash container.

BACKGROUND ART

A problem frequently encountered by cigarette smokers was misplacement of the package of cigarettes, the cigarette lighter, or the ash tray. A combination holding device for conjointly retaining these smokers' articles would thus provide a useful appliance. Another inconvenience of many of the devices of the prior art was the inability to secure those receptacles to a support surface for ready access. This facility was particularly advantageous when it was desired to retain those smokers' articles at selected locations, e.g. at one's work station, on a vehicle dashboard, and in similar surroundings.

Previous attempts to accommodate those situations included a holder, such as shown in U.S. Pat. No. 4,252,237, which was intended for limited securement only to those surfaces compatible with a clip attachment. Similarly, the cigarette lighter support, shown in U.S. Pat. No. 4,363,432, was intended to be worn by the user as by attachment to a belt or a shirt pocket. Furthermore, that device was directed to a singular lighter support and not designed for containing a plurality of smokers' articles. A table lighter holder, as shown in U.S. Pat. No. 4,133,450, also had special application. Another receptacle for a cigarette lighter was shown in U.S. Pat. No. 3,763,996 however, that device did not provide a pocket for receiving the lighter and did not include an ash container. A combination case was shown in U.S. Pat. No. 2,031,363; that receptacle as noted, did not include separable components nor was it capable of receiving smokers' articles as in the instant invention.

DISCLOSURE OF THE INVENTION

Briefly, the nature of this invention involves a smokers' convenience caddy attachable to a substantially vertical support surface and includes interconnected components forming compartments for holding specific smokers' articles. The assembly is adapted for alternate usage in combination or independently.

A compendium of this invention includes a base unit adapted for accommodating a package of cigarettes, a pod for accepting a cigarette lighter and being selectively securable to an end of the base unit and an ash container removably attachable to a front face of the base unit. A rear face of the base unit includes a peelable adhesive strip. The ash container is suspended from the front face by rivets projecting therefrom and the lighter pod is provided with an adhesive backing for securement to an end face of the base unit.

It should be apparent that the combined structure is effective for providing a smokers' convenience caddy for centralized location of smokers' articles and further for providing selective securement thereof to a substantially vertical surface. The versatility of this device is further enhanced for the reason that the several components can be detached from the base unit and separately utilized.

In view of the foregoing, it should be apparent that the present invention overcomes many of the shortcomings of the prior art and provides an improved receptacle having independent compartments for retaining a plurality of smokers' articles.

Having thus summarized the invention, it will be seen that it is an object thereof to provide a smokers' convenience caddy of the general character described herein which is not subject to the aforementioned disadvantages.

Another object of this invention is to provide a smokers' convenience caddy having detachable components suitable for alternate and independent usage.

A further object of this invention is to provide a smokers' convenience caddy including separate compartments for containing cigarettes, a cigarette lighter, and an ash receptacle.

Other objects of this invention in part will be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown some of the various possible exemplary embodiments of the invention;

FIG. 1 is a perspective view of a smokers' convenience caddy in accordance with this invention showing a base unit with a package of cigarettes partially withdrawn, a lighter receiving pod affixed to an end of the base unit and an ash container suspended on the base unit;

FIG. 2 is a plan view of the smokers' convenience caddy as shown in FIG. 1 illustrating the securement of the ash container to the base unit;

FIG. 3 is a sectional view taken substantially through line 3—3 of FIG. 1 showing the ash container and rear wall of the base unit;

BEST MODE FOR CARRYING OUT THE INVENITON

Figure 4:
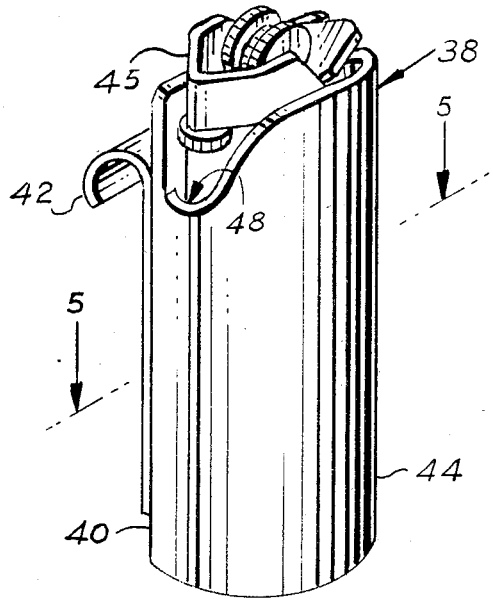
FIG. 4 is a perspective view to a slightly enlarged scale showing the cigarette lighter receiving pod with a cigarette lighter contained therein and further illustrating a peelable adhesive backing.
Figure 5:
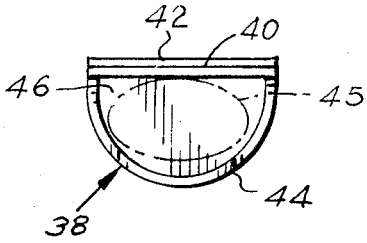
FIG. 5 is a sectional view taken substantially along line 5—5 of FIG. 4 showing the semi-circular configuration of the lighter pod and its adaptability for receiving a cigarette lighter having an oval cross section.
Figure 6:
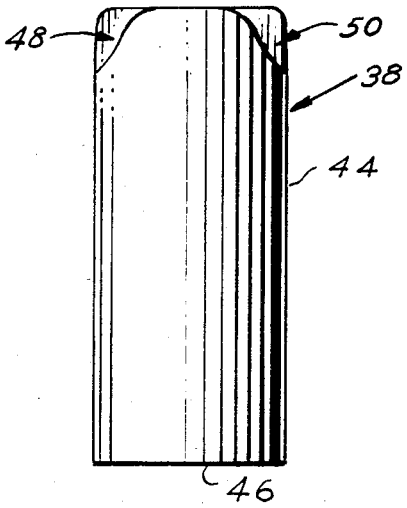
FIG. 6 is a front elevational view of the lighter pod showing a finger-grip recess for grasping the cigarette lighter.

Referring now in detail to the drawings, the reference numeral 10 denotes generally a smokers' convenience caddy of this invention.

The convenience caddy 10 includes a substantially rectangular base unit 12 being opened at an upper end and being dimensioned so as to slidably receive a conventional package of cigarettes 14 within the open end. The base unit 12 is provided with a rear wall 16 extending above the open end and includes an aperture 18 engageable by a hook, nail projection or similar supporting member extendable from a substantially vertical surface. The rear wall 16 is also provided with a peelable adhesive strip or backing 20 for alternate securement to the surface by direct contact. The base unit 12 also includes two parallel end walls 22, 24, a front wall 26, and a bottom wall 27.

An ash container 28 is removably attachable to the front wall 26 and, for that purpose, is provided with keyhole apertures 30, 32 registrable with complementary rivet head projections 34, 36. It should be apparent that the ash container 28 can thus be readily removed from the base unit 12 as for emptying or cleaning same and further can be placed at a remote location during actual usage.

A third component of the smokers' convenience caddy is a cigarette lighter pod 38. The pod 38 is provided with a planar rear wall 40 having a width substantially conforming to the end walls 22, 24 of the base unit 12 and is further provided with a peelable adhesive strip or backing 42. A convex outer wall 44 extends from the rear wall 40 to provide a compartment particularly suitable for accommodating a liquid butane cigarette lighter 45, e.g., as manufactured by the Bic Pen Corporation. A bottom wall 46 completes the enclosure.

It should be noted that the convex wall 44 also includes a finger recess 48, 50 to facilitate removal and insertion of the cigarette lighter.

In accordance with the concept of this invention, the cigarette lighter pod 38 as well as the ash container 28 and the base unit 12 can be utilized independently or in combination as shown in FIG. 1. In connection with the construction of this apparatus, it should be noted that the component units are preferably fabricated of a thermoplastic material which can be injection molded and the ash container 28 provided with a fire retardant composition.

Thus, it will be seen that there is provided a smokers' convenience caddy which achieves the various objects of the invention and which is well adapted to meet conditions of practical use.

Since various possible embodiments might be made of the present invention or various changes might be made in the exemplary embodiment set forth, it is to be understood that all materials shown and described in the accompanying drawings are to be interpreted as illustrative and not in a limiting sense.

Having thus described the invention, there is claimed as new and desired to be secured by Letters Patent:

1. A smoker's convienence caddy comprised of a combination of detachable component units made of plastic material and formed into a compartmentalized composite structure including a base unit adapted for accommodating a package of cigarettes, said base unit defining a front wall, a rear wall, a pair of end walls and a bottom wall with said rear wall having an adhesive backing for removably attaching the base unit to a support surface, said rear wall further extending said front wall and said end walls for providing a maximum adhesive bonding area, an ash container, said ash container including aperture engagement means, said front wall of the base unit including a mounting support adapted for interlocking connection with the aperture engagement means for releasably supporting the ash container on the base unit, a lighter pod adapted for accommodating a cigarette lighter, said lighter pod having a substantially planar rear wall, a curved front wall, said rear pod wall having a width dimension substantially conforming to the end wall of the base unit, said lighter pod further including a bottom wall extending between the curved front pod wall and rear pod wall to provide an enclosure having an open end opposite the bottom pod wall, said rear pod wall having adhesive bonding means for selectively attaching the lighter pod either to the end wall or a planar support surface, said rear pod wall further having a height dimension greater than said curved front pod wall for providing a maximum adhesive bonding area, said curved front pod wall being convex and extending to the bottom pod wall for defining an enclosure adapted to accommodate a cigarette lighter having an oval cross-sectional shape, said curved front pod wall further defining a recessed portion proximate to the open end, said recessed portion providing finger grip access for withdrawing the cigarette lighter from the lighter pod, whereby said several components are adapted for alternate independent utilization.

* * * * *